US010117461B2

(12) United States Patent
Chen

(10) Patent No.: US 10,117,461 B2
(45) Date of Patent: Nov. 6, 2018

(54) ELECTRONIC CIGARETTE

(71) Applicant: Shenzhen Smoore Technology Limited, Shenzhen, Guangdong (CN)

(72) Inventor: Zhiping Chen, Shenzhen (CN)

(73) Assignee: Shenzhen Smoore Technology Limited, Shenzhen (CN)

( * ) Notice: Subject to any disclaimer, the term of this patent is extended or adjusted under 35 U.S.C. 154(b) by 230 days.

(21) Appl. No.: 14/992,045

(22) Filed: Jan. 11, 2016

(65) Prior Publication Data

US 2016/0262455 A1 Sep. 15, 2016

(30) Foreign Application Priority Data

Mar. 10, 2015 (CN) ..... 2015 1 0105545

(51) Int. Cl.
*A24F 47/00* (2006.01)

(52) U.S. Cl.
CPC ..... *A24F 47/008* (2013.01)

(58) Field of Classification Search
CPC ..... A24F 47/004; A24F 47/008; B01F 13/002
USPC ..... 131/328, 329; 392/397, 404; 219/534
See application file for complete search history.

(56) References Cited

U.S. PATENT DOCUMENTS 4,622,454 A * 11/1986 Castille ..... B60N 3/14 16/433
6,188,042 B1 * 2/2001 Sheen ..... B60N 3/14 219/266
8,857,446 B2 * 10/2014 Wu ..... A24F 47/008 128/202.21
2003/0209531 A1 * 11/2003 Mattis ..... B60N 3/14 219/265
2009/0272379 A1 * 11/2009 Thorens ..... A24F 47/008 128/202.21
2012/0111347 A1 * 5/2012 Hon ..... A24F 47/008 131/329
2012/0260927 A1 * 10/2012 Liu ..... A24F 47/008 131/329
2012/0285475 A1 * 11/2012 Liu ..... A24F 47/008 131/329
2013/0056013 A1 * 3/2013 Terry ..... A24F 47/008 131/328
2013/0081642 A1 * 4/2013 Safari ..... A24F 47/008 131/329
2013/0167853 A1 * 7/2013 Liu ..... A24F 47/008 131/329
2013/0192617 A1 * 8/2013 Thompson ..... A24F 47/008 131/329

(Continued)

*Primary Examiner* — Jimmy Chou

(57) ABSTRACT

The present invention provides an electronic cigarette, including an atomizer device and a battery device. The atomizer device includes an electrically-conductive air flowing pipe and an atomizer assembly disposed on the air flowing pipe. A liquid reservoir room is defined outside of the air flowing pipe. The atomizer assembly includes a liquid delivery wick and a heating member arranged on the liquid delivery wick. The liquid delivery wick is arranged across the air flowing pipe with at least one end thereof to be extended into the liquid reservoir room. The heating member electrically connects with the air flowing pipe, the air flowing pipe electrically connects with an electrode of the battery device, and the heating member electrically connects with the other electrode of the battery device by a conductor penetrating through the air flowing pipe.

13 Claims, 7 Drawing Sheets

(56) References Cited

U.S. PATENT DOCUMENTS

2013/0192618 A1* 8/2013 Li ..... A24F 47/008 131/329
2013/0213419 A1* 8/2013 Tucker ..... A24F 47/008 131/328
2013/0319436 A1* 12/2013 Liu ..... A24F 47/008 131/329
2013/0319438 A1* 12/2013 Liu ..... A24F 47/008 131/329
2013/0340778 A1* 12/2013 Liu ..... A24F 47/002 131/329
2014/0007891 A1* 1/2014 Liu ..... A24F 47/008 131/329
2014/0014126 A1* 1/2014 Peleg ..... A24F 47/008 131/329
2014/0048086 A1* 2/2014 Zhanghua ..... A24F 47/008 131/329
2014/0103020 A1* 4/2014 Al-Qaffas ..... F23Q 7/16 219/201
2014/0150810 A1* 6/2014 Hon ..... H04R 1/028 131/329
2014/0196733 A1* 7/2014 Liu ..... A24F 47/008 131/329
2014/0196734 A1* 7/2014 Liu ..... A24F 47/008 131/329
2014/0216484 A1* 8/2014 Liu ..... A24F 47/008 131/329
2014/0224244 A1* 8/2014 Liu ..... H05B 3/14 128/202.21
2014/0230835 A1* 8/2014 Saliman ..... A24F 47/008 131/329
2014/0238421 A1* 8/2014 Shapiro ..... A24F 47/008 131/328
2014/0253144 A1* 9/2014 Novak, III ..... G01R 31/327 324/550
2014/0261486 A1* 9/2014 Potter ..... A24F 47/008 131/328
2014/0261487 A1* 9/2014 Chapman ..... A24F 47/008 131/328
2014/0261500 A1* 9/2014 Park ..... A24F 47/008 131/329
2014/0270729 A1* 9/2014 DePiano ..... A24F 47/008 392/397
2014/0283857 A1* 9/2014 Liu ..... A24F 47/008 131/329
2014/0290674 A1* 10/2014 Liu ..... A24F 47/008 131/329
2014/0299137 A1* 10/2014 Kieckbusch ..... A24F 47/008 131/328
2014/0311505 A1* 10/2014 Liu ..... A24F 47/008 131/329
2014/0355969 A1* 12/2014 Stern ..... A24F 47/008 392/390
2015/0000684 A1* 1/2015 Wu ..... A24F 47/008 131/329
2015/0020831 A1* 1/2015 Weigensberg ..... A24F 47/008 131/329
2015/0027461 A1* 1/2015 Liu ..... A24F 47/008 131/329
2015/0027473 A1* 1/2015 Graf ..... F22B 1/288 131/329
2015/0034104 A1* 2/2015 Zhou ..... A24F 47/008 131/329
2015/0053215 A1* 2/2015 Liu ..... A24F 47/008 131/329
2015/0053218 A1* 2/2015 Liu ..... A61M 11/042 131/329
2015/0173422 A1* 6/2015 Liu ..... H05B 1/0244 131/329
2015/0181936 A1* 7/2015 Lyubomirskiy ..... A24F 47/008 219/553
2015/0196055 A1* 7/2015 Liu ..... A24F 47/008 131/329
2015/0196059 A1* 7/2015 Liu ..... A24F 47/008 131/329
2015/0201674 A1* 7/2015 Dooly ..... A24F 47/008 53/432
2015/0216232 A1* 8/2015 Bless ..... A24F 47/008 131/328
2015/0245658 A1* 9/2015 Worm ..... A24F 47/008 131/328
2015/0257445 A1* 9/2015 Henry, Jr. ..... A24F 47/008 131/328
2015/0272217 A1* 10/2015 Chen ..... A24F 47/008 131/329
2015/0272218 A1* 10/2015 Chen ..... H05B 3/44 131/329
2015/0282527 A1* 10/2015 Henry, Jr. ..... A24F 47/008 131/328
2015/0305408 A1* 10/2015 Liu ..... H05B 3/44 131/329
2015/0313282 A1* 11/2015 Ademe ..... A24F 47/008 131/329
2015/0313284 A1* 11/2015 Liu ..... A24F 47/008 131/329
2015/0366265 A1* 12/2015 Lansing ..... A24F 47/004 131/329
2016/0007651 A1* 1/2016 Ampolini ..... A24F 47/008 131/328
2016/0066621 A1* 3/2016 DePiano ..... A24F 47/008 131/328
2016/0095352 A1* 4/2016 Liu ..... H01M 2/34 131/329
2016/0113326 A1* 4/2016 Li ..... H05B 3/00 131/329
2016/0128386 A1* 5/2016 Chen ..... A24F 47/008 131/329
2016/0128389 A1* 5/2016 Lamb ..... A24F 47/008 131/328
2016/0262455 A1* 9/2016 Chen ..... A24F 47/008

* cited by examiner

ELECTRONIC CIGARETTE

CROSS-REFERENCE TO RELATED APPLICATIONS

The present application claims the benefit of Chinese Patent Application No. 201510105545.3 filed on Mar. 10, 2015; the contents of which are hereby incorporated by reference.

TECHNICAL FIELD

The present invention relates to a cigarette substitute, and more particularly to an electronic cigarette.

BACKGROUND

An electronic cigarette in related art usually includes a cartridge, an atomizer device and a power source device. The atomizer device includes an insulated air flowing pipe and an atomizer assembly disposed on the air flowing pipe. Heating members of the atomizer assembly are respectively in electrical connection with two electrodes of a battery device for heat generation. This electrical connection method is complicated in assembling, and causes increase in both labour power and manufacture cost.

SUMMARY OF THIS DISCLOSURE

To overcome the above mentioned disadvantage, an electronic cigarette is provided, which includes an atomizer device and a battery device.

The atomizer device includes an electrically-conductive air flowing pipe and an atomizer assembly disposed on the air flowing pipe. A liquid reservoir room is defined outside of the air flowing pipe. The atomizer assembly includes a liquid delivery wick and a heating member arranged on the liquid delivery wick. The liquid delivery wick is arranged across the air flowing pipe with at least one end thereof to be extended into the liquid reservoir room. The heating member electrically connects with the air flowing pipe, the air flowing pipe electrically connects with an electrode of the battery device, and the heating member electrically connects with the other electrode of the battery device by a conductor penetrating through the air flowing pipe.

BRIEF DESCRIPTION OF THE DRAWINGS

In combination drawings with embodiments below to further illustrate the present invention, in the drawings.

DETAILED DESCRIPTION

For better understanding technical features, purpose and effect of the present invention, the following explanation in combination with drawings provides specific details for these embodiments of the present invention.

As shown in FIGS. 1-6, an electronic cigarette in a preferred embodiment of the present invention includes a cartridge 10, an atomizer device 20 and a battery device 30. The cartridge 10 is mounted to the atomizer device 20, and is capable of rotating relative to the atomizer device 20 between a first position and a second position. The atomizer device 20 can rotate relative to the battery device 30 between a third position and a fourth position. Moreover, a rotation direction from the first position to the second position is consistent with that from the third position to the fourth position. For the rotation operation of these two connection joints, the connection joints can be opened or closed sequentially based on different friction forces between two parts at the connection joints.

Figure 1:
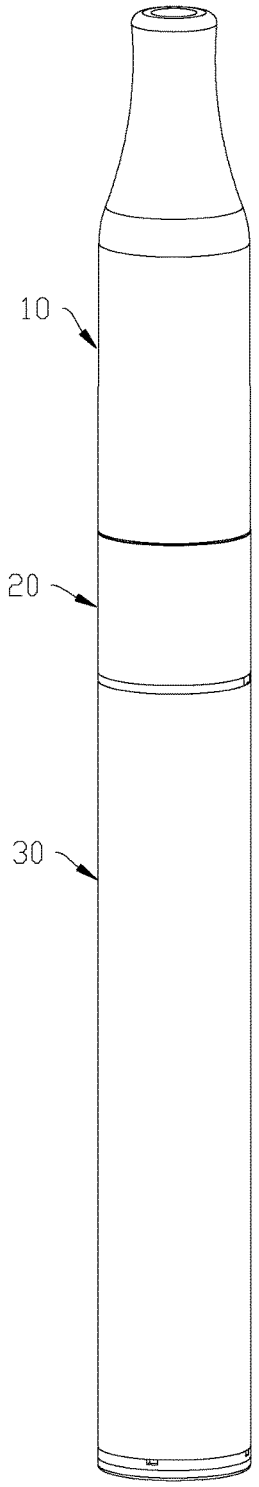
FIG. 1 is a schematic diagram illustrating a three-dimensional electronic cigarette according to an embodiment of the present invention.
Figure 2:
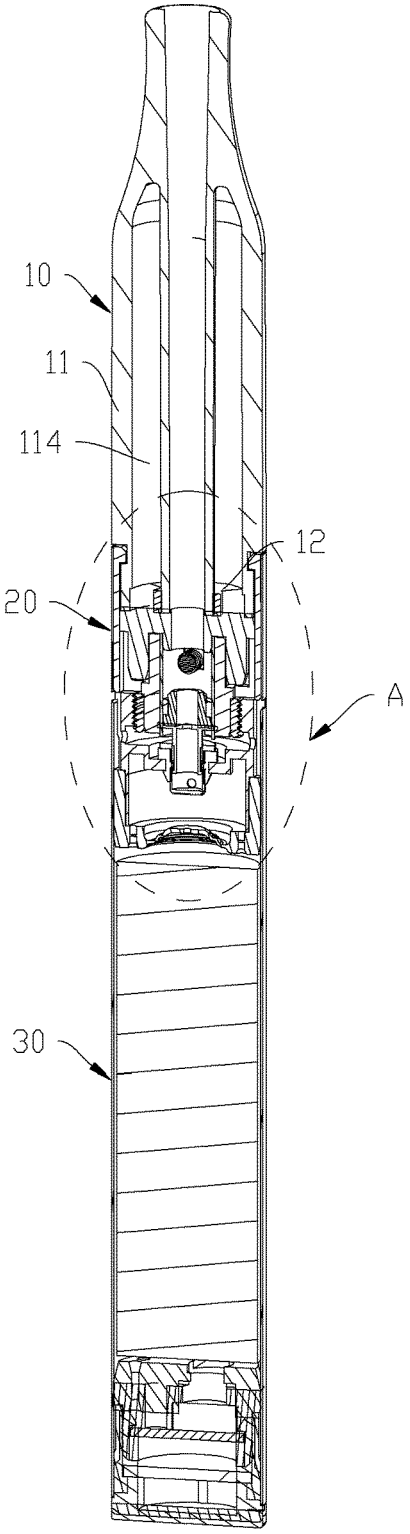
FIG. 2 is a structure diagram for the electronic cigarette in FIG. 1 along an axial section direction.
Figure 3:
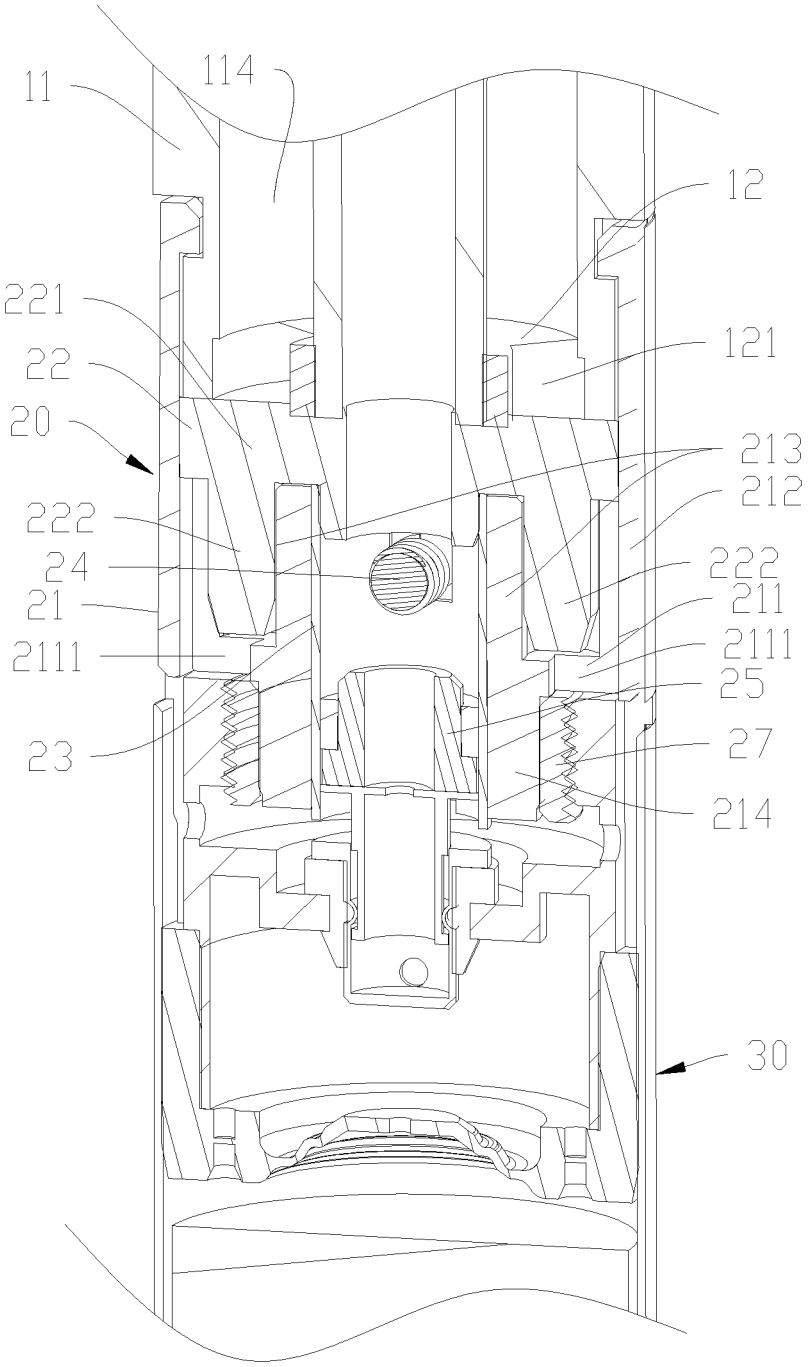
FIG. 3 is an enlarged view for a partial view A in FIG. 2.
Figure 4:
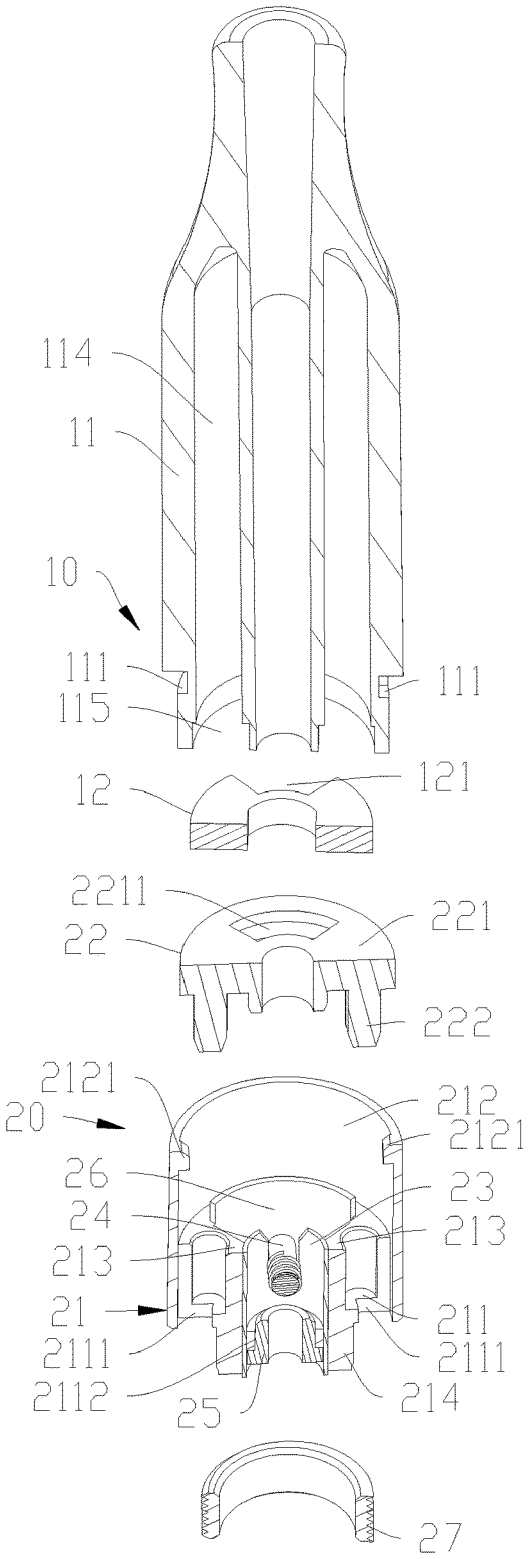
FIG. 4 is a disassembled view for a cartridge in FIG. 2, where the cartridge is located at a first position relative to an atomizer device.
Figure 5:
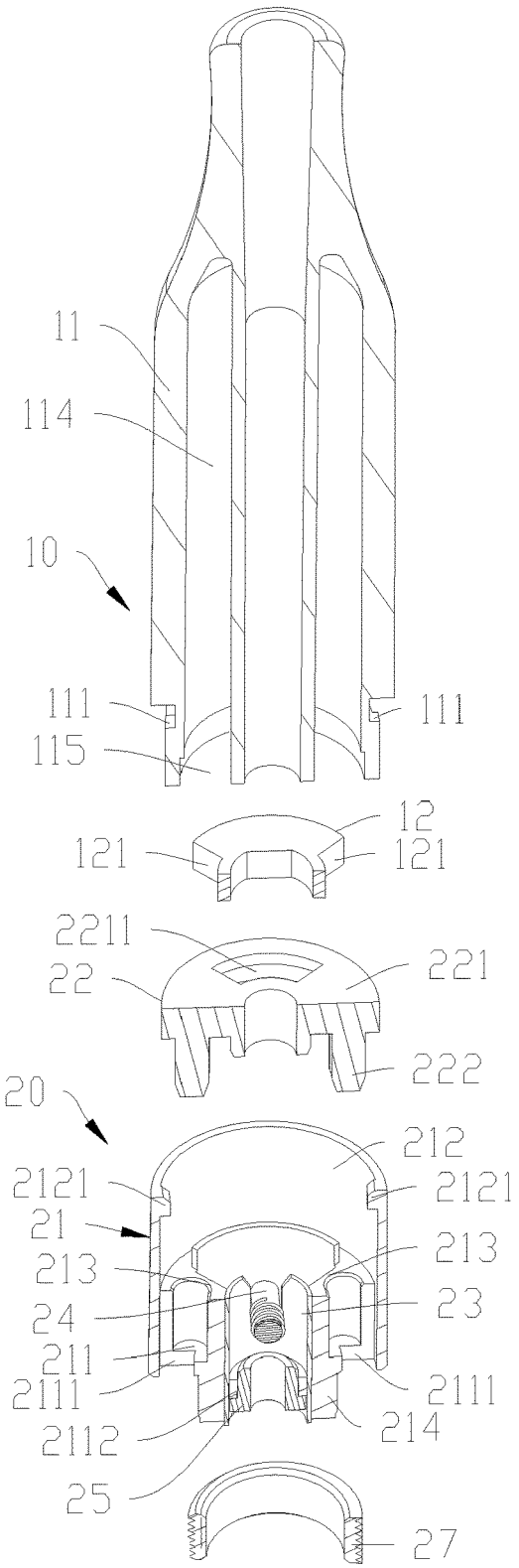
FIG. 5 is a disassembled view for a cartridge in FIG. 2, where the cartridge is located at a second position relative to an atomizer device.
Figure 6:
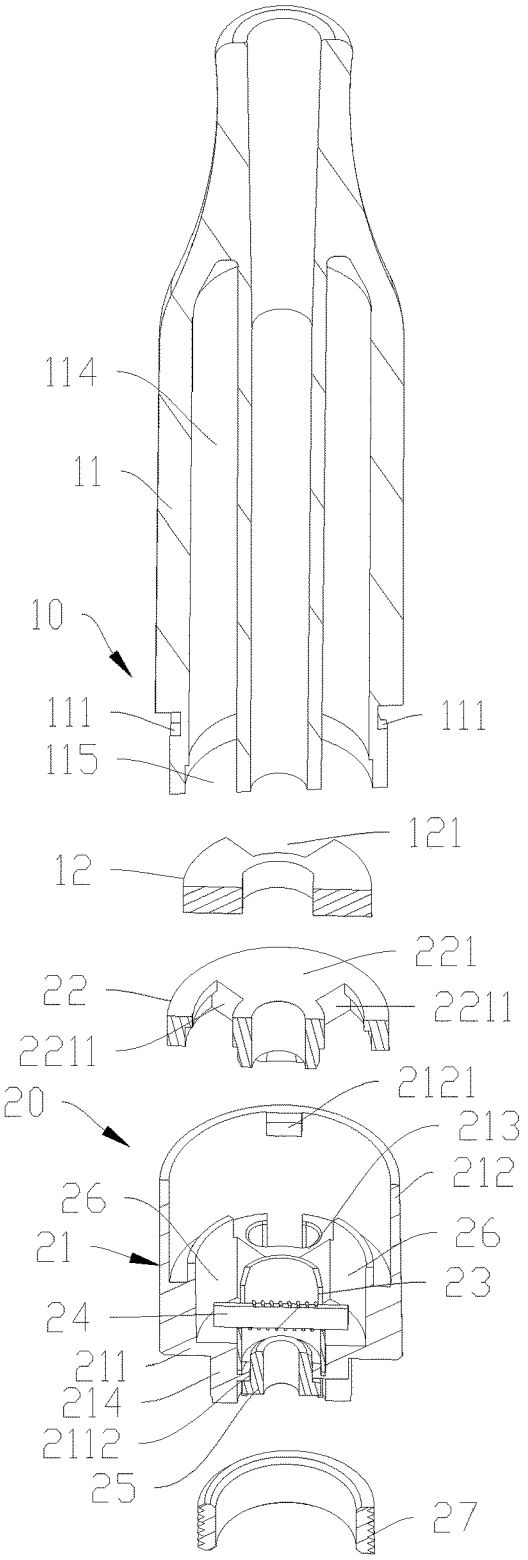
FIG. 6 is a section diagram from another view for a cartridge in FIG. 2, where the cartridge is located at a second position relative to an atomizer device.
Figure 7:
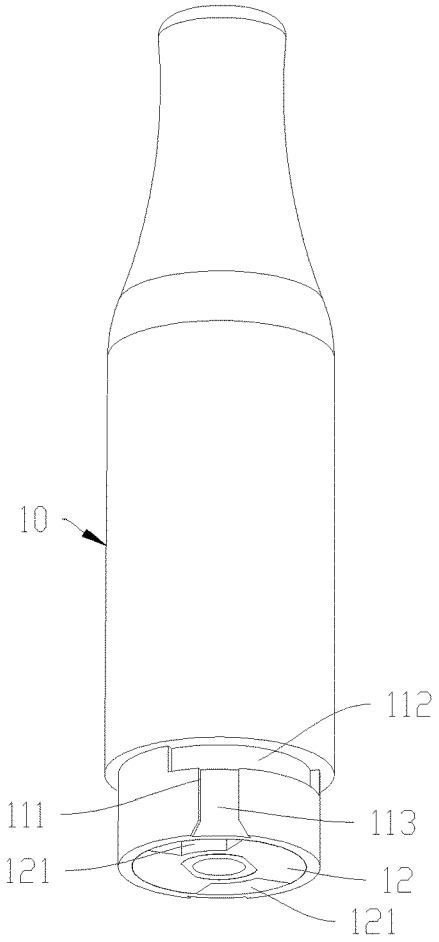
FIG. 7 is a stereo-diagram for a cartridge.

Further referring to FIG. 7, the cartridge 10 includes a cartridge body 11 and a first cover body 12. The cartridge body 11 includes a liquid reservoir chamber 114 and an opening 115 corresponding to the liquid reservoir chamber 114. The first cover body 12 which faces the atomizer device 20 is arranged on the opening 115 to cover the liquid reservoir chamber 114. The first cover body 12 is provided with a liquid outlet 121 for communicating an internal of the liquid reservoir chamber 114 with an outside, where there can be one or more liquid outlet(s) 121 here. In some other embodiments, the first cover body 12 can be a first wall portion that is integrally formed with the cartridge body 11 and faces the atomizer device 20, where the liquid outlet 121 is defined on the first wall portion.

Preferably, the cartridge 10 and the atomizer device 20 are installed together coaxially. The cartridge 10 is capable of rotating around an axis thereof relatively to the atomizer device 20 between the first position and the second position. In some other embodiments, the cartridge 10 and the atomizer device 20 can be installed in a non-coaxial mode, eccentrically for example.

Figure 8:
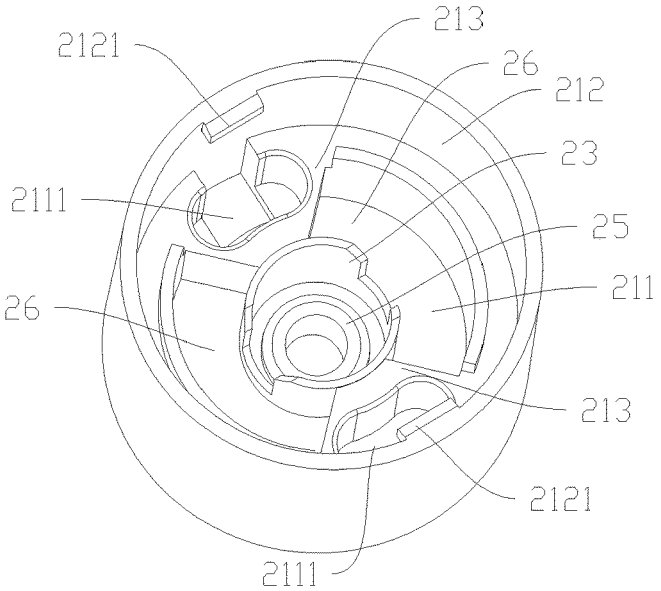
FIG. 8 is a stereo-diagram illustrating an atomizer holder, an air flowing pipe and a pressing ring that are assembled together.

As shown in FIGS. 3-6, the atomizer device 20 includes an atomizer holder 21, a second cover body 22, an air flowing pipe 23, an atomizer assembly 24 and a pressing ring 25. With reference to FIG. 8, the atomizer holder 21 includes an annular baseplate 211, a tubular atomizer pipe 212 that is defined on an outer ring of the annular baseplate 211 and extends towards the cartridge 10, and a retaining wall 213 that is defined on the annular baseplate 211 and extends towards the cartridge 10.

The atomizer pipe 212 surrounds an end portion of the cartridge 10, and two latching blocks 2121 are arranged circumferentially on an internal wall of the atomizer pipe 212. Further referring to FIG. 7, two latching slots 111 corresponding to the two latching blocks 2121 are provided on an outer ring at one end portion of the cartridge body 11 corresponding to the atomizer device 20. The latching slot 111 includes a rotation slot 112 extending circumferentially, and a guiding slot 113 for communicating the rotation slot 112 with the end portion of the cartridge 10 corresponding to the atomizer pipe 212. The guiding slot 113 guides the latching block 2121 into the rotation slot 112, and the rotation slot 112 provides rotation space for the cartridge 10. The two latching blocks 2121 and the two latching slots 111 are respectively arranged symmetrically to ensure equal force thereon. Provided that the cartridge 10 and the atomizer pipe 212 can rotate relative to each other, there can be one or three or any other numbers of the latching block(s) 2121 and the latching slot(s) 111.

Figure 9:
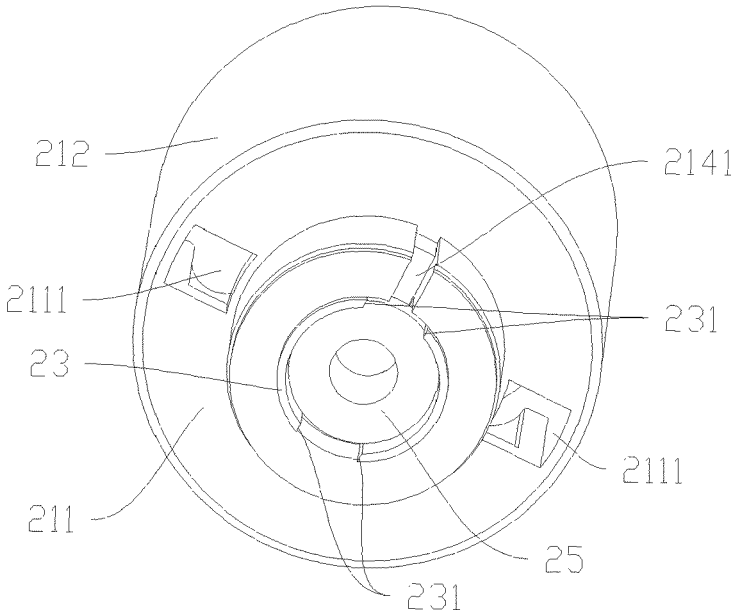
FIG. 9 is a stereo-diagram from another view illustrating an atomizer holder, an air flowing pipe and a pressing ring that are assembled together.

As shown in FIGS. 8 and 9, the annular baseplate 211 is provided with a mold releasing hole 2111 which corresponds to the latching block 2121 axially. In this way, a mold core for molding the latching block 2121 can be released through the mold releasing hole 2111 away from the latching block 2121 along the axial direction during the molding of the atomizer holder 21, and thus the latching block 2121 can be directly formed on the internal wall of the atomizer pipe 212. A through hole 2112 is defined at an inner ring of the annular baseplate 211, where the air flowing pipe 23 is embedded on the annular baseplate 211 to communicate with the through hole 2112 and cooperate with the retaining wall 213.

Again as shown in FIGS. 3-6, the second cover body 22 includes a sealing gasket 221 and a positioning post 222 arranged on the sealing gasket 221. The sealing gasket 221 is also annularly shaped; it is spaced from the annular baseplate 211, and it covers an end surface of the retaining wall 213 and the air flowing pipe 23, so that the liquid reservoir room 26 is enclosed by the sealing cover, the annular baseplate 211 and the atomizer pipe 212 on one side of the retaining wall 213 facing away from the mold releasing hole 2111. In some other embodiments, the air flowing pipe 23 can be integrally formed with the atomizer holder 21. A through hole at the centre of the sealing gasket 221 communicates with the air flowing pipe 23, and a liquid inlet 2211 communicating with the liquid reservoir room 26 is defined on the sealing gasket 221. There can be one or more liquid inlet(s) 2211, where a location and dimension of the liquid inlet correspond to those of the liquid outlet 121. When the cartridge 10 is located at the first position, the liquid outlet 121 misaligns with the liquid inlet 2211 to disconnect the liquid reservoir chamber 114 with the liquid reservoir room 26. When the cartridge 10 is located at the second position, the liquid outlet 121 aligns with the liquid inlet 2211, to communicate the liquid reservoir chamber 114 with the liquid reservoir room 26.

The mold releasing hole 2111 is offset relative to the liquid inlet 2211 along the circumferential direction, and an isolation space is defined by the retaining wall 213 on one side facing the mold releasing hole 2111 so that the mold releasing hole 2111 is disconnected with the liquid inlet 2211. The positioning post 222 axially extends into the isolation space to prevent the sealing gasket 221 from rotation. The first cover body 12 of the cartridge 10 can rotate around the axis thereof and abut against the sealing gasket 221, thereby ensuring that liquid solution may not leak laterally when flowing between the liquid outlet 121 and the liquid inlet 2211. In some other embodiments, the sealing gasket 221 can also be a second wall portion integrally arranged with the atomizer holder 21.

Figure 10:
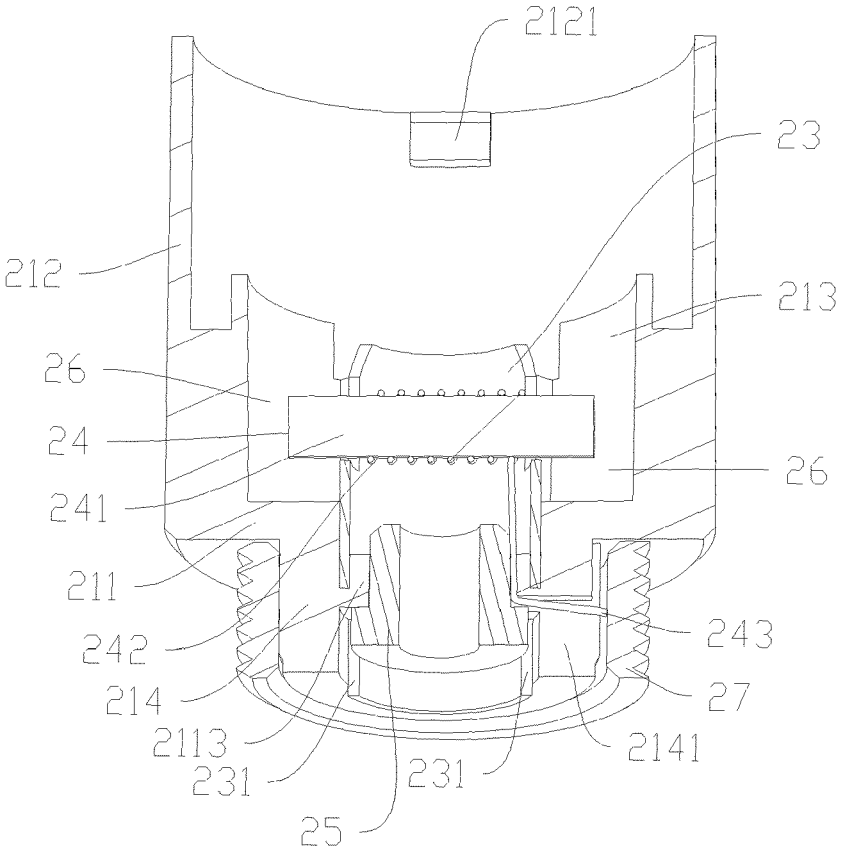
FIG. 10 is a schematic diagram along an axial section direction illustrating an atomizer holder, an air flowing pipe, an atomizer assembly, a pressing ring and a threaded sleeve.

As shown in FIG. 10, the atomizer assembly 24 includes a liquid delivery wick 241 and a heating member 242 arranged on the liquid delivery wick 241. The liquid delivery wick 241 is arranged across the air flowing pipe 23, and at least one end thereof extends into the liquid reservoir room 26. Further, the air flowing pipe 23 is an electrically-conductive element; the heating member 242 electrically connects with the air flowing pipe 23, the air flowing pipe 23 electrically connects with an electrode of the battery device 30, and the heating member 242 electrically connects with the other electrode of the battery device 30 by a conductor 243 penetrating through the air flowing pipe 23. Preferably, the air flowing pipe 23 is an electrically-conductive tubular structure that is made of electrically-conductive material. In some other embodiments, an electrically-conductive portion can be provided on the air flowing pipe 23, where this electrically-conductive portion electrically connects with both the heating member 242 and the electrode of the battery device 30.

A spacer 2113 is defined between the inner ring of the annular baseplate 211 and the air flowing pipe 23, so as to achieve insulated isolation between the conductor 243 and the air flowing pipe 23 to prevent short circuit. Preferably, the atomizer device 20 also includes the pressing ring 25. An outer ring of the pressing ring 25 coordinates with an inner ring of the spacer 2113, such that the conductor 243 is press-fixed between the pressing ring 25 and the spacer 2113 to avoid any motion.

The atomizer holder 21 further includes a connection pipe section 214 extending from the annular baseplate 211 towards the battery device 30. A periphery of the connection pipe section 214 is surrounded by an electrically-conductive threaded conduit 27, so as to have threaded fit and electrical connection with the battery device 30. Alternatively, the connection pipe section can also electrically connect with the battery device 30 through the lead-out conductor 243. A gap 231 for laterally leading out the conductor 243 is arranged on a side wall of the air flowing pipe 23, where the conductor 243 is led out laterally to electrically connect with the threaded conduit 27, thereby facilitating the electrical connection with the battery device 30. Preferably, two gaps 231 are arranged oppositely on the side wall of the air flowing pipe 23, and this arrangement can facilitate using a mold to punch the tubular air flowing pipe 23 at one time.

The side wall of the connection pipe section 214 is provided with a lead-out slot 2141 that corresponds to one of the gaps 231. The lead-out conductor 243 can become recessed using the lead-out slot, so as to avoid space occupation and keep a good appearance. Further, a width of the gap 231 is larger than that of the lead-out slot 2141, and the portion of the lead-out slot 2141 facing the gap 231 falls within the range of the gap 231. This can prevent the conductor 243 from contacting the air flowing pipe 23 to cause the short circuit when passing through the lead-out slot 2141.

Again as shown in FIGS. 3-6, the atomizer holder 21 and the battery device 30 are in threaded fit with each other. When the atomizer device 20 is located at the third position, the atomizer device 20 disconnects with the battery device 30; when the atomizer device 20 is located at the fourth position, the atomizer device 20 connects with the battery device 30, and the air flowing pipe 23 and the threaded conduit 27 are respectively in electrical connection with the two electrodes of the battery device 30. When the rotation friction force between the cartridge 10 and the atomizer device 20 is different from that between the atomizer device 20 and the battery device 30, the electronic cigarette can be held and rotated at its two ends following both a forward direction and a backward direction along the axial direction. In this case, sequential rotation can take place between the cartridge 10 and the atomizer device 20 and between the atomizer device 20 and the battery device 30.

When the rotation friction force between the cartridge 10 and the atomizer device 20 is larger than that between the atomizer device 20 and the battery device 30, the atomizer device 20 is first rotated relative to the battery device 30 from the third position to the fourth position under the action of the different friction forces; after the atomizer device 20 and the battery device 30 are installed into the position, the cartridge 10 is then rotated relative to the atomizer device 20 from the first position to the second position, such that the liquid inlet 2211 and the liquid outlet 121 are rotated from the misaligned state to a communication state to make the liquid solution within the liquid reservoir chamber 114 flow to the liquid reservoir room 26 for immediate usage. Alternatively, it can determine whether to continue the rotation operation to communicate the liquid inlet 2211 with the liquid outlet 121 when the atomizer device 20 and the battery device 30 are installed into the position. When there is no need to use the liquid solution within the liquid reservoir chamber 114, the cartridge 10 can be kept at the first position.

When the rotation friction force between the cartridge 10 and the atomizer device 20 is smaller than that between the atomizer device 20 and the battery device 30, the cartridge 10 is first rotated relative to the atomizer device 20 from the first position to the second position under the action of the different friction forces, and thus the liquid inlet 2211 and the liquid outlet 121 are rotated from the misaligned state to the communication state to make the liquid solution within the liquid reservoir chamber 114 flow to the liquid reservoir room 26; after that, the atomizer device 20 is rotated relative to the battery device 30 from the third position to the fourth position. Since the liquid solution has already flown into the liquid reservoir room 26 and been absorbed by the liquid delivery wick 241, a user can immediately use the electronic cigarette once the atomizer assembly 24 is powered on by the battery device 30.

It is noteworthy that, the above-mentioned technical features can be used in any combination without restriction.

The disclosure described above of the present invention is illustrative but not restrictive scope of the present invention. Any equivalent structure, or equivalent process transformation, or directly or indirectly usage in other related technical field, all those be made in the same way are included within the protection scope of the present invention.

The invention claimed is:

1. An electronic cigarette, comprising an atomizer device and a battery device; wherein the atomizer device comprises an electrically-conductive air flowing pipe and an atomizer assembly disposed on the electrically-conductive air flowing pipe; a liquid reservoir room is defined outside of the electrically-conductive air flowing pipe; the atomizer assembly comprises a liquid delivery wick and a heating member arranged on the liquid delivery wick; the liquid delivery wick is arranged across the electrically-conductive air flowing pipe with at least one end thereof to be extended into the liquid reservoir room; wherein the heating member electrically connects with the electrically-conductive air flowing pipe, the electrically-conductive air flowing pipe electrically connects with an electrode of the battery device, and the heating member electrically connects with another electrode of the battery device by a conductor penetrating through the electrically-conductive air flowing pipe; the atomizer device further comprises an atomizer holder comprising an annular baseplate; the electrically-conductive air flowing pipe is an electrically-conductive tubular structure that is made of electrically-conductive material; a spacer is defined between an inner ring of the annular baseplate and the electrically-conductive air flowing pipe to have insulated isolation between the conductor and the electrically-conductive air flowing pipe; the atomizer device also comprises a pressing ring; an outer ring of the pressing ring coordinates with an inner ring of the spacer, to press-fix the conductor between the pressing ring and the spacer; and a gap for laterally leading out the conductor is arranged on a side wall of the electrically-conductive air flowing pipe.

2. The electronic cigarette of claim 1, wherein the electrically-conductive air flowing pipe is arranged on the annular baseplate, and is in communication with a through hole of the annular baseplate.

3. The electronic cigarette of claim 2, wherein the electrically-conductive air flowing pipe is embedded on the annular baseplate.

4. The electronic cigarette of claim 1, wherein the atomizer holder further comprises a connection pipe section extending from the annular baseplate towards the battery device; the connection pipe section is provided with a lead-out slot that is located corresponding to the gap for laterally leading out the conductor; a width of the gap is larger than that of the lead-out slot, and a portion of the lead-out slot facing the gap falls within a range of the gap.

5. The electronic cigarette of claim 4, wherein there are two said gaps on the electrically-conductive air flowing pipe, and the two gaps are respectively arranged on two opposite sides of the side wall of the electrically-conductive air flowing pipe.

6. The electronic cigarette of claim 1, furthering comprising a cartridge; the cartridge includes a liquid reservoir chamber and at least one liquid outlet(s) for communicating an internal of the liquid reservoir chamber with an outside; the atomizer device comprises the liquid reservoir room and at least one liquid inlet(s) for communicating an internal of the liquid reservoir room with the outside; the cartridge is mounted to the atomizer device, and is capable of rotating relative to the atomizer device between a first position and a second position; when the cartridge is located at the first position, the at least one liquid outlet(s) misalign(s) with the at least one liquid inlet(s) to disconnect the liquid reservoir chamber with the liquid reservoir room; when the cartridge is located at the second position, the at least one liquid outlet(s) aligns with the at least one liquid inlet(s) to communicate the liquid reservoir chamber with the liquid reservoir room; the atomizer device is capable of rotating relative to the battery device between a third position and a fourth position; when the atomizer device is located at the third position, the atomizer device disconnects with the battery device; when the atomizer device is located at the fourth position, the atomizer device connects with the battery device; wherein a rotation direction from the first position to the second position is consistent with that from the third position to the fourth position.

7. An electronic cigarette, comprising an atomizer device and a battery device; wherein the atomizer device comprises an electrically-conductive air flowing pipe and an atomizer assembly disposed on the electrically-conductive air flowing pipe; a liquid reservoir room is defined outside of the electrically-conductive air flowing pipe; the atomizer assembly comprises a liquid delivery wick and a heating member arranged on the liquid delivery wick; the liquid delivery wick is arranged across the electrically-conductive air flowing pipe with at least one end thereof to be extended into the liquid reservoir room; wherein the heating member electrically connects with the electrically-conductive air flowing pipe, the electrically-conductive air flowing pipe electrically connects with an electrode of the battery device, and the heating member electrically connects with the other electrode of the battery device by a conductor; the conductor is arranged in an air flowing passage defined in the electrically-conductive air flowing pipe, one end of the conductor is connected to the heating member, and another end of the conductor extends out of the electrically-conductive air flowing pipe by penetrating through a side wall of the electrically-conductive air flowing pipe; the atomizer device further comprises an atomizer holder; the atomizer holder comprises an annular baseplate, wherein the electrically-conductive air flowing pipe is arranged on the annular baseplate, and is in communication with a through hole of the annular baseplate; a gap for laterally leading out the conductor is arranged on a side wall of the electrically-conductive air flowing pipe; the atomizer holder further comprises a connection pipe section extending from the annular baseplate towards the battery device; the connection pipe section is provided with a lead-out slot that is located corresponding to the gap for laterally leading out the conductor; a width of the gap is larger than that of the lead-out slot, and a portion of the lead-out slot facing the gap falls within a range of the gap.

8. The electronic cigarette of claim 7, wherein the electrically-conductive air flowing pipe is embedded on the annular baseplate.

9. The electronic cigarette of claim 7, wherein the electrically-conductive air flowing pipe is an electrically-conductive tubular structure that is made of electrically-conductive material.

10. The electronic cigarette of claim 9, wherein a spacer is defined between an inner ring of the annular baseplate and the electrically-conductive air flowing pipe to have insulated isolation between the conductor and the electrically-conductive air flowing pipe.

11. The electronic cigarette of claim 10, wherein the atomizer device also comprises a pressing ring; an outer ring of the pressing ring coordinates with an inner ring of the spacer, to press-fix the conductor between the pressing ring and the spacer.

12. The electronic cigarette of claim 7, wherein there are two said gaps on the electrically-conductive air flowing pipe, and the two gaps are respectively arranged on two opposite sides of the side wall of the electrically-conductive air flowing pipe.

13. The electronic cigarette of claim 7, furthering comprising a cartridge; the cartridge includes a liquid reservoir chamber and at least one liquid outlet(s) for communicating an internal of the liquid reservoir chamber with an outside; the atomizer device comprises the liquid reservoir room and at least one liquid inlet(s) for communicating an internal of the liquid reservoir room with the outside; the cartridge is mounted to the atomizer device, and is capable of rotating relative to the atomizer device between a first position and a second position; when the cartridge is located at the first position, the at least one liquid outlet(s) misalign(s) with the at least one liquid inlet(s) to disconnect the liquid reservoir chamber with the liquid reservoir room; when the cartridge is located at the second position, the at least one liquid outlet(s) aligns with the at least one liquid inlet(s) to communicate the liquid reservoir chamber with the liquid reservoir room; the atomizer device is capable of rotating relative to the battery device between a third position and a fourth position; when the atomizer device is located at the third position, the atomizer device disconnects with the battery device; when the atomizer device is located at the fourth position, the atomizer device connects with the battery device; wherein a rotation direction from the first position to the second position is consistent with that from the third position to the fourth position.

* * * * *